US006536880B2

(12) United States Patent
Takagi

(10) Patent No.: US 6,536,880 B2
(45) Date of Patent: Mar. 25, 2003

(54) PIEZOELECTRIC INK JET PRINTER HEAD AND METHOD FOR MANUFACTURING SAME

(75) Inventor: Atsuhiro Takagi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/983,486

(22) Filed: Oct. 24, 2001

(65) Prior Publication Data

US 2002/0051041 A1 May 2, 2002

(30) Foreign Application Priority Data

Oct. 26, 2000 (JP) ..... 2000-327754

(51) Int. Cl.[7] ..... B41J 2/045
(52) U.S. Cl. ..... 347/72
(58) Field of Search ..... 347/68–72; 310/328, 310/366; 29/25.35, 890.1

(56) References Cited

U.S. PATENT DOCUMENTS 5,086,308 A * 2/1992 Takahashi et al. ..... 347/72
5,266,964 A * 11/1993 Takahashi et al. ..... 347/72
5,402,159 A * 3/1995 Takahashi et al. ..... 347/9
5,639,508 A * 6/1997 Okawa et al. ..... 427/100
5,912,526 A * 6/1999 Okawa et al. ..... 310/328
6,142,614 A * 11/2000 Hashizume et al. ..... 347/70
6,142,615 A * 11/2000 Qiu et al. ..... 347/70
6,443,566 B1 * 9/2002 Watanabe et al. ..... 347/68
6,450,626 B2 * 9/2002 Ikeda et al. ..... 347/70

* cited by examiner

*Primary Examiner*—Judy Nguyen
(74) *Attorney, Agent, or Firm*—Oliff & Berridge, PLC

(57) ABSTRACT

A plate-shaped piezoelectric actuator 20 is formed from ten piezoelectric sheets 21 to 30 that are stacked in a laminated configuration. Drive electrodes 36 are formed on the upper surface of each piezoelectric sheet 26, 28, and 30 at positions that correspond to pressure chambers 16 provided on a cavity plate 10. A band-shaped common electrode 35 is formed on the surface of each of the piezoelectric sheets 23, 24, 25, 27, and 29. The piezoelectric sheets 25 to 30 are subjected to polarization processes by applying a voltage between the common electrodes 35 and corresponding ones of the drive electrodes 36 and between the drive electrode 36 of the lowermost piezoelectric sheet 30 and the cavity plate 10. Then, the common electrodes 35 provided on the piezoelectric sheets 25, 27, 29 and the cavity plate 10 are all connected to the ground 60. With this configuration, the piezoelectric sheet 30 as well as the piezoelectric sheets 26 to 29 function as active layers and deform by the piezoelectric effect.

12 Claims, 11 Drawing Sheets

PIEZOELECTRIC INK JET PRINTER HEAD AND METHOD FOR MANUFACTURING SAME

BACKGROUND OF THE INVENTION

1. Field of the Invention

The present invention relates to a piezoelectric ink jet printer head and a method for manufacturing the same.

2. Description of the Related Art

FIG. 1 shows a conventional ink jet printer head 100 used in an ink jet printer. The ink jet printer head 100 includes a cavity plate 130 and a piezoelectric actuator 110. The cavity plate 130 is formed with a plurality of ink chambers 131. The piezoelectric actuator 110 is adhered onto the cavity plate 130 so as to cover the ink chambers 131. When a voltage is applied to the piezoelectric actuator 110, the piezoelectric actuator 110 deforms into the ink chambers 131, whereupon the volume of the ink chambers 131 decreases. As a result, the pressure in the ink chambers 131 increases so that an ink droplet is ejected from the orifices 132 of the ink chambers 131.

The piezoelectric actuator 110 includes active layers 120 and inactive binding layers 150. The active layers 120 include piezoelectric ceramic layers 140 that are formed with an internal negative electrode layer 142, laminated in alternation with piezoelectric ceramic layers 140 that are formed with internal positive electrode layers 144*a*, 144*b*, and 144*c*. The internal positive electrode layers 144*a*, 144*b*, and 144*c* are aligned with the ink chambers 131 of the cavity plate 130. The binding layers 150 includes a plurality of layers of piezoelectric ceramic layers 171 that are unrelated to drive of the ink jet printer head 100.

When a drive voltage is applied between the internal positive electrode layers 144*a* to 144*c* and the corresponding internal negative electrode layer 142, the lowermost piezoelectric ceramic layer 140, that is, the piezoelectric ceramic layer 140 adhered to the cavity place 130, is actually inactive and does not add to the drive force of the ink jet printer head 100.

SUMMARY OF THE INVENTION

However, because the lowermost piezoelectric ceramic layer 140 is inactive in this way, a sufficiently high positive pressure is not generated in the ink chambers 131. It is conceivable to screen print another electrode for driving the lowermost piezoelectric ceramic layers 140 onto the surface where the lowermost ceramic layer 140 attaches to the cavity plate 130. However, a separate insulation film would need to be formed on this electrode to protect it from the ink in the ink chambers 131. This extra film would increase production costs.

It is an objective of the present invention to overcome the above-described problems and provide a piezoelectric type ink jet printer head and a method of manufacturing a piezoelectric type ink jet printer head that enables the lowermost piezoelectric ceramic layer that is adhered to the cavity plate to be driven as an active layer.

In order to achieve the above and other objectives, there is provided an ink jet head including a cavity plate and a piezoelectric actuator. The cavity plate is formed with a plurality of nozzles and a plurality of pressure chambers in one-to-one correspondence with the nozzles. The piezoelectric actuator includes a plurality of first piezoelectric sheets and a plurality of second piezoelectric sheets laminated in alternation. Each of the first piezoelectric sheets being provided with a first electrode, and each of the second piezoelectric sheets is provided with a second electrode. One of the first piezoelectric sheets has a first surface on which the first electrode is provided and a second surface opposite from the first surface and provided with no electrode, the second surface being attached to the cavity plate while covering over the pressure chambers. The cavity plate and the second electrodes are all connected to a same potential.

There is also provided a manufacturing method for an ink jet head. The method includes the steps of forming a laminated structure of a plurality of first piezoelectric sheets and a plurality of second piezoelectric sheets laminated in alternation, each of the first piezoelectric sheets being provided with a first electrode on a first surface, each of the second piezoelectric sheets being provided with a second electrode, attaching a second surface of a lower most one of the first piezoelectric sheets to a cavity plate, the second surface being opposite from the first surface, and polarizing the first piezoelectric sheets and the second piezoelectric sheets by applying a voltage between the first electrodes and corresponding ones of second electrodes and between the first electrode on the lower most one of the first piezoelectric sheets and the cavity plate.

BRIEF DESCRIPTION OF THE DRAWINGS

The above and other objects, features and advantages of the invention will become more apparent from reading the following description of the embodiment taken in connection with the accompanying drawings in which.

PREFERRED EMBODIMENT OF THE INVENTION

Next, an ink jet printer head with a configuration, and produced by a method, according to the present invention will be described while referring to the attached drawings.

It should be noted that the following explanation of the embodiment will be easier to understand by referring to U.S patent application Ser. Nos. 09/897,394; 09/933,155;

09/933,156; and U.S Patent Application titled LAMINATED AND BONDED CONSTRUCTION OF THIN PLATE PARTS filed with the U.S. Patent and Trademark Office on Sep. 21, 2001, the disclosure of all of which is incorporated herein by reference in their entirety.

Figure 1:
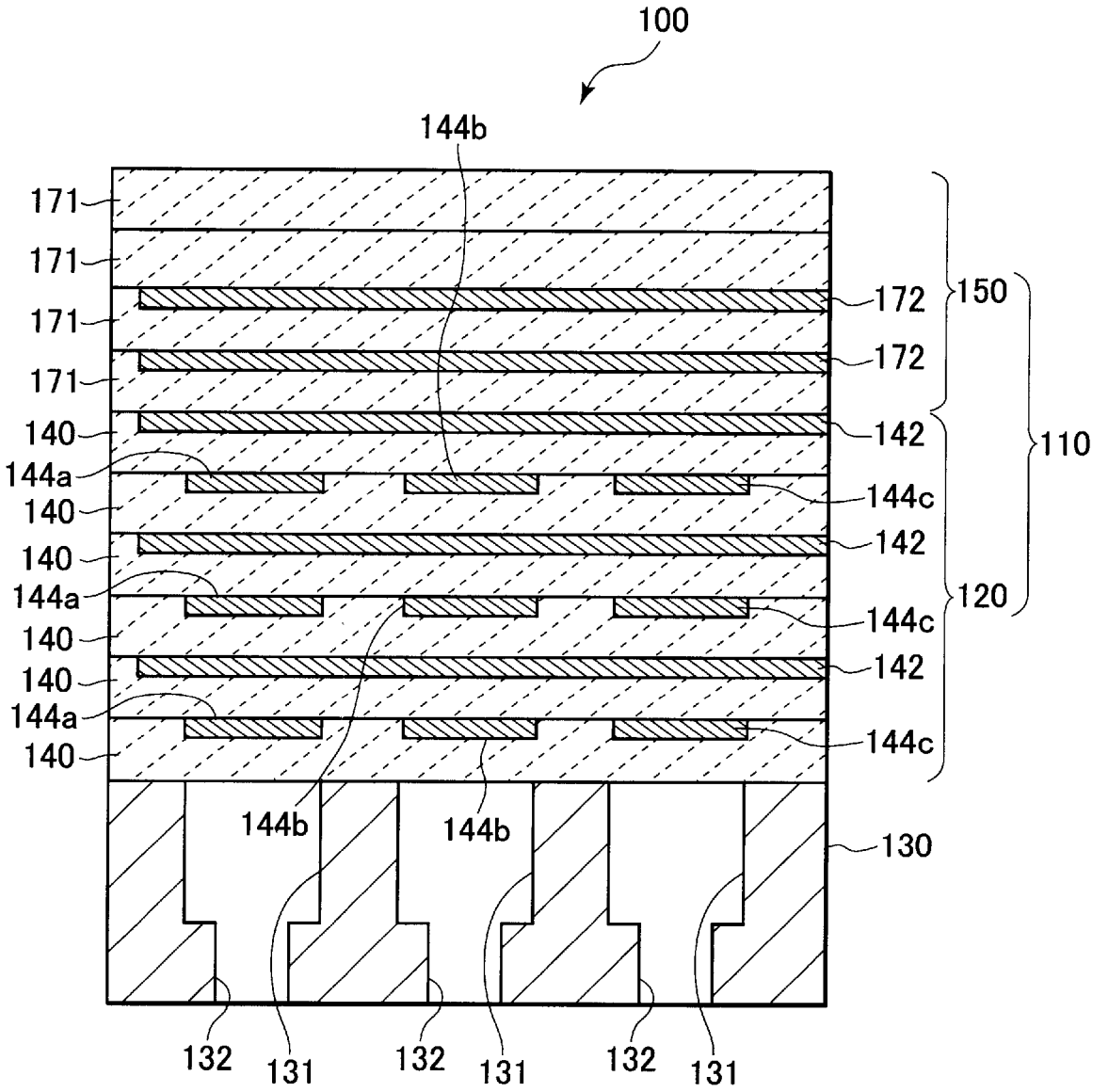
FIG.1 PRIOR ART
FIG. 1 is cross-sectional view showing a conventional ink jet printer head.
Figure 2:
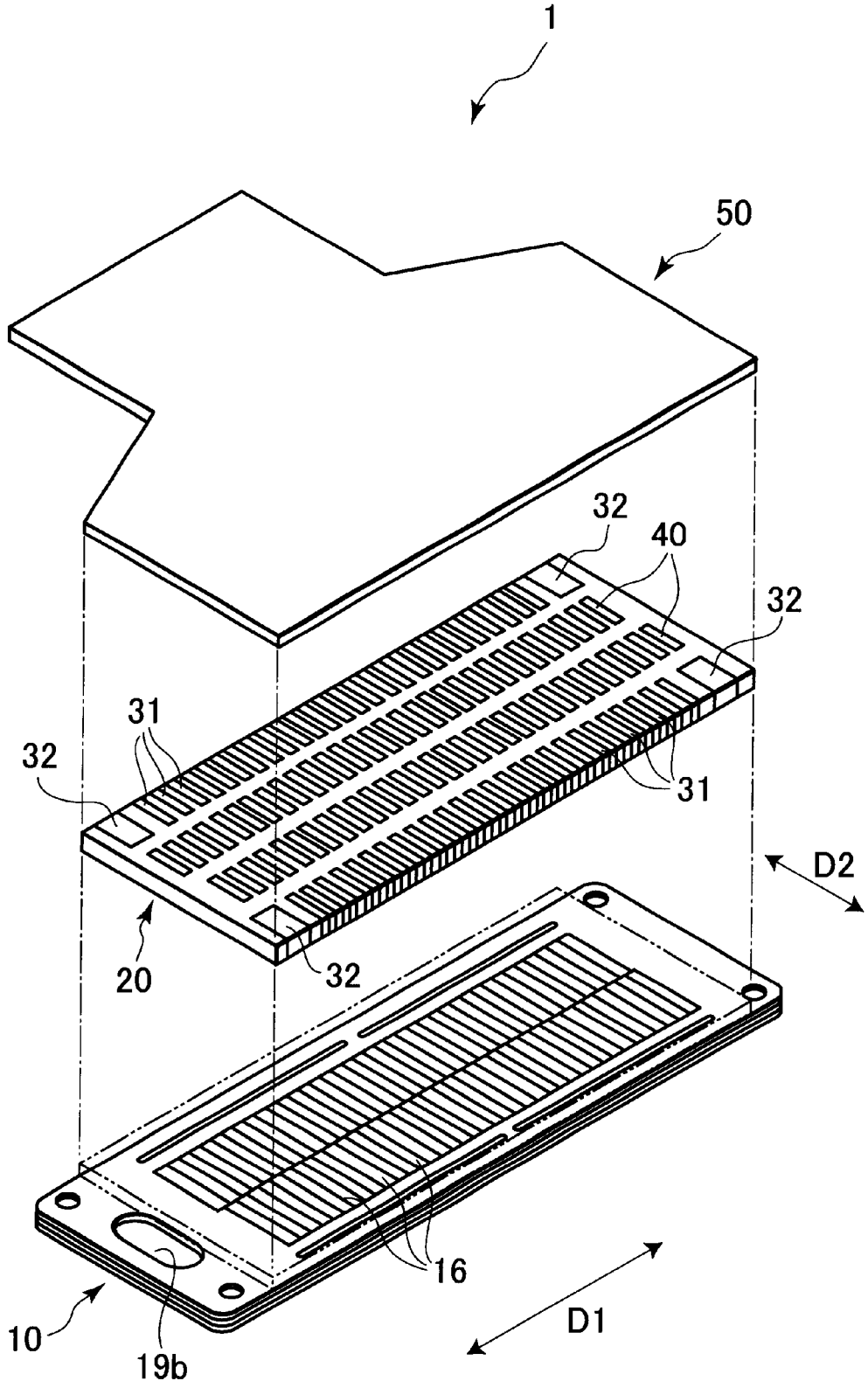
FIG. 2 is an exploded perspective view showing an ink jet printer head according to an embodiment of the present invention.

As shown in FIG. 2, an ink jet printer head 1 includes a cavity plate 10, a plate-shaped actuator 20, and a flexible flat cable 50. The cavity plate 10 has a laminated configuration formed from a plurality of approximately rectangular conductive metal plates. Pressure chambers 16 are formed by grooves in the surface of the cavity plate 10. The pressure chambers 16 are aligned in parallel with the lengthwise direction D1 of the cavity plate 10 and are elongated in the direction D2 perpendicular to the lengthwise direction D1 of the cavity plate 10. The actuator 20 is formed in a substantially rectangular plate shape and is adhered on the cavity plate 10 so as to cover the pressure chambers 16 formed in the cavity plate 10. The flexible flat cable 50 is for connecting the head 1 with an external device and is connected in an overlapping manner with the top of the actuator 20.

Figure 3:
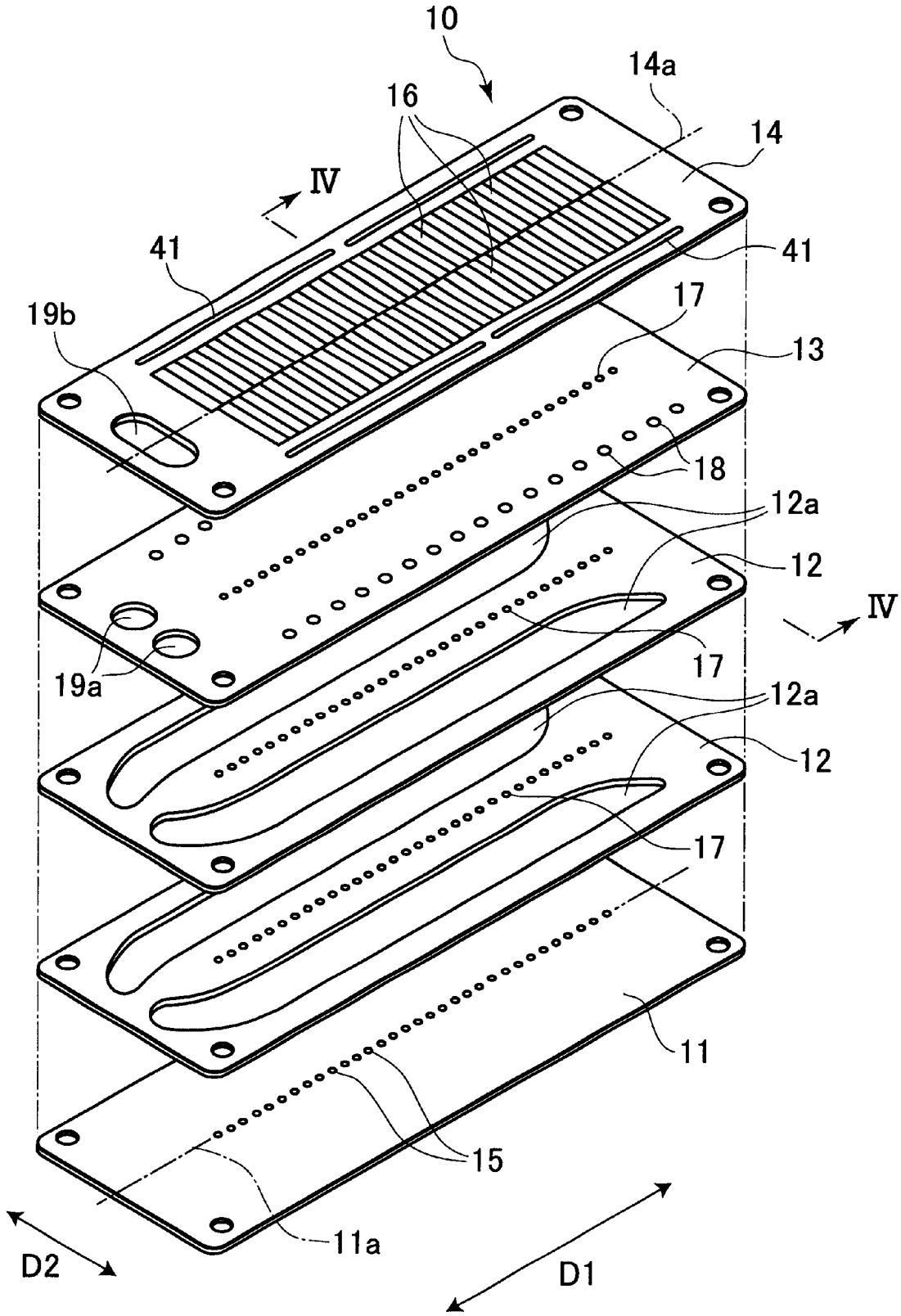
FIG. 3 is an exploded perspective view showing components of a cavity plate of the head of FIG. 2.
Figure 4:
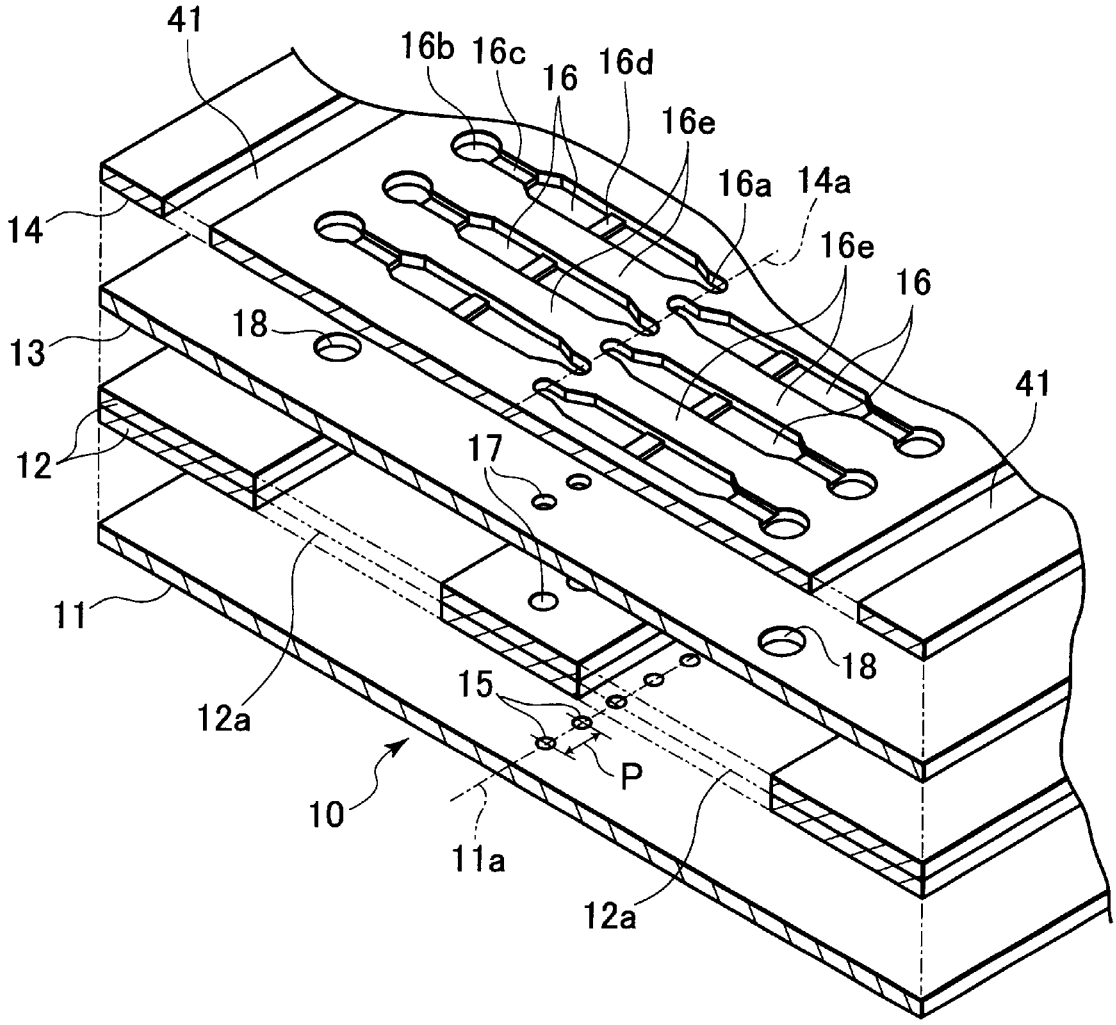
FIG. 4 is a cross-sectional perspective view taken along a line IV—IV of FIG. 3.

As shown in FIGS. 3 and 4, the cavity plate 10 includes five thin metal plates laminated together. The thin plates include a nozzle plate 11, two manifold plates 12, 12, a spacer plate 13, and a base plate 14. The nozzle plate 11 is formed with small-diameter ink ejection nozzles 15. The nozzles 15 are formed in a row that extend in the lengthwise direction D1 of the nozzle plate 11. The nozzles 15 are opened separated from each other by small pitch P following a central line 11*a*.

The pair of manifold plates 12, 12 are each formed with a pair of ink channels 12*a* extending along the sides of the row of nozzles 15 in the lengthwise direction D1. Because the manifold plates 12, 12 are laminated onto the nozzle plate 11 and the spacer plate 13, the ink channels 12*a* are in a sealed condition.

The base plate 14 is formed with narrow-width pressure chambers 16 that extend in the widthwise direction D2, which is perpendicular to an imaginary central line 14*a* that follows the lengthwise direction D1. One half of the pressure chambers 16 are disposed substantially to the left of the imaginary central line 14*a* and the other half is disposed substantially to the right of the central line 14*a* in a staggered arrangement. Tips 16*a* of the pressure chambers 16 are aligned on the central line 14*a*.

Small through holes 17 are opened in the spacer plate 13 and the manifold plates 12, 12. The through holes 17 bring the tips 16*a* of the pressure chambers 16 into fluid communication with the corresponding nozzles 15. Rows of through holes 18 are opened in both left and right sides of the spacer plate 13. The through holes 18 bring the other ends 16*b* of the pressure chambers 16 into fluid communication with the ink channels 12*a* of the manifold plates 12. Supply hole 19*b* is opened in one end of the base plate 14, and supply holes 19*a* are opened in one end of the space plate 13.

With this configuration, the ink supplied from an ink tank (not shown) flows through the supply holes 19*a*, 19*b*, the ink channels 12*a*, 12*b*, the through holes 18, the pressure chambers 16, and the through holes 17 in this order, and then the ink reaches the nozzles 15 corresponding to the pressure chambers 16.

It should be noted that as shown in FIG. 4, each pressure chamber 16 is formed with a pinched portion 16*c* for restricting flow amount of ink. The pinched portions 16*c* are located adjacent to the end 16*b* of the corresponding pressure chamber 16 and are formed by formed the thickness of plate slightly thicker than surrounding areas. Also, a connection rib 16 for strengthening the central portion of the pressure chamber is formed integrally with the plate by forming the plate slightly thicker. Also, columns 16*e* are formed in the pressure chambers 16 for partitioning the pressure chambers 16. Grooves 41 are formed in between the pressure chambers 16*a* and the lengthwise ends of the base plate 14.

Figure 5:
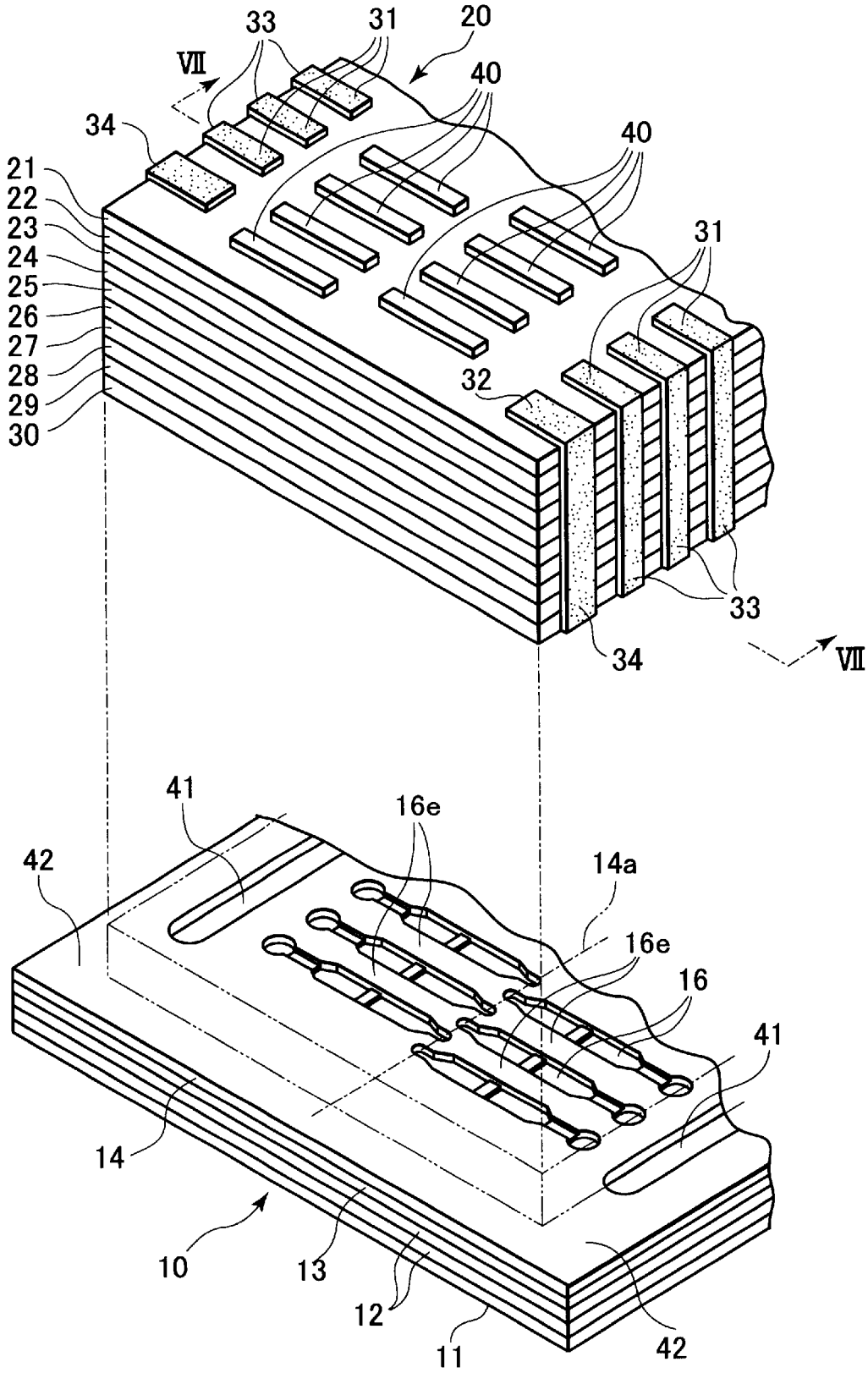
FIG. 5 is a magnified partial perspective view showing a plate-shaped piezoelectric actuator of the head of FIG. 2 separated from the cavity plate.
Figure 6:
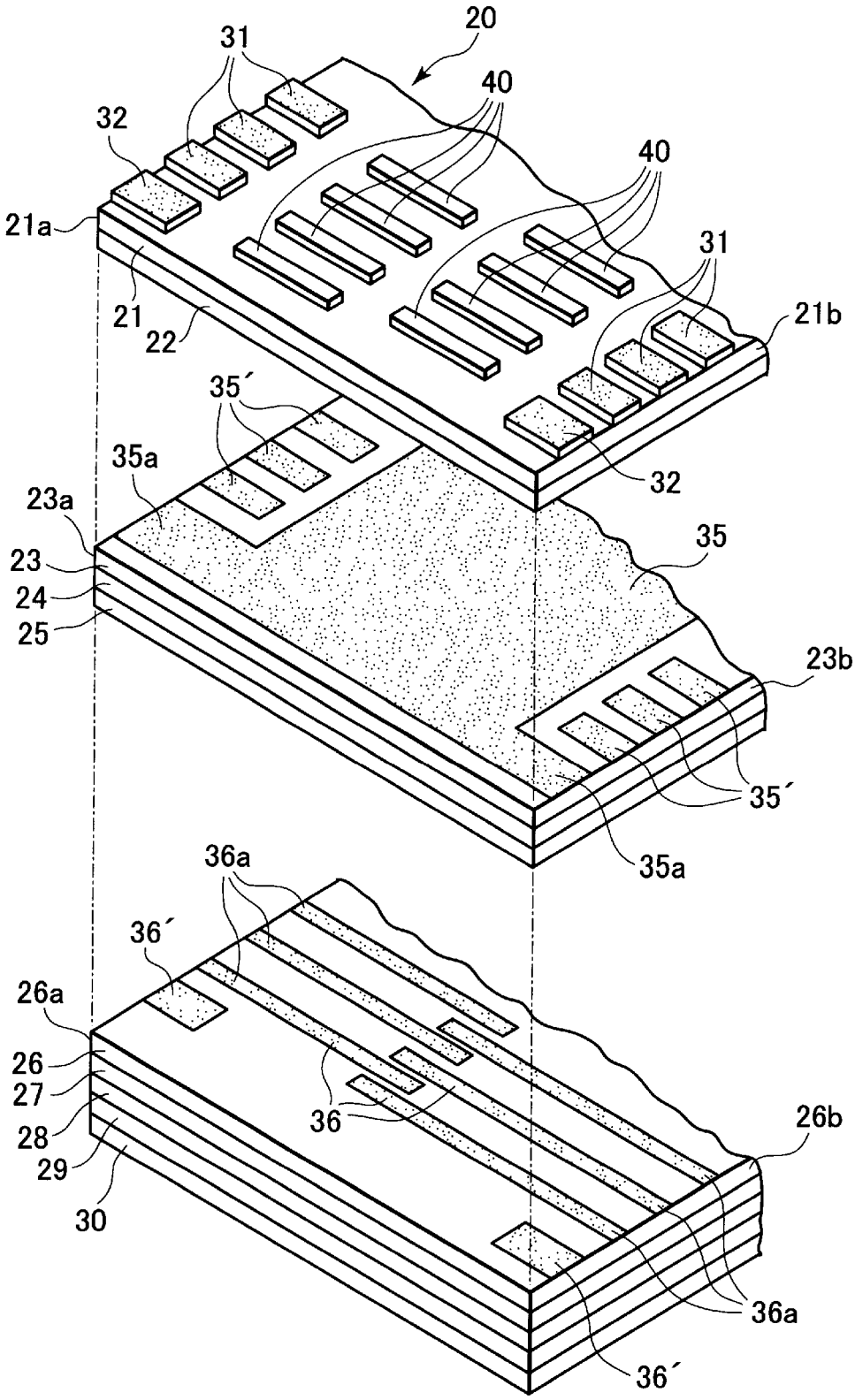
FIG. 6 is an exploded partial perspective view showing the plate-shaped piezoelectric actuator.
Figure 7:
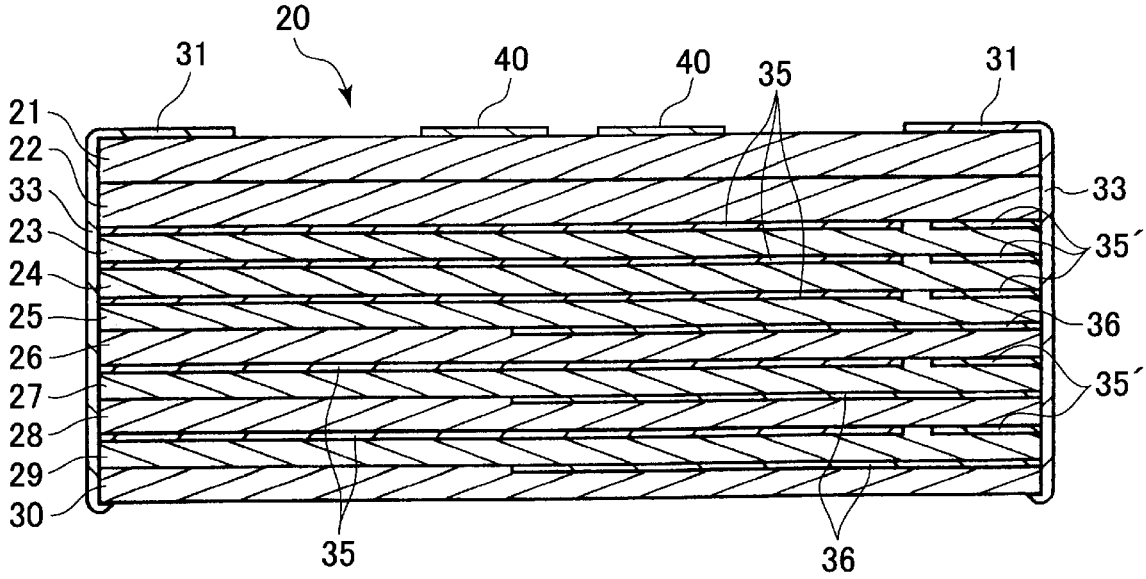
FIG. 7 is a cross-sectional view taken along a line VII—VII of FIG. 5.
Figure 8:
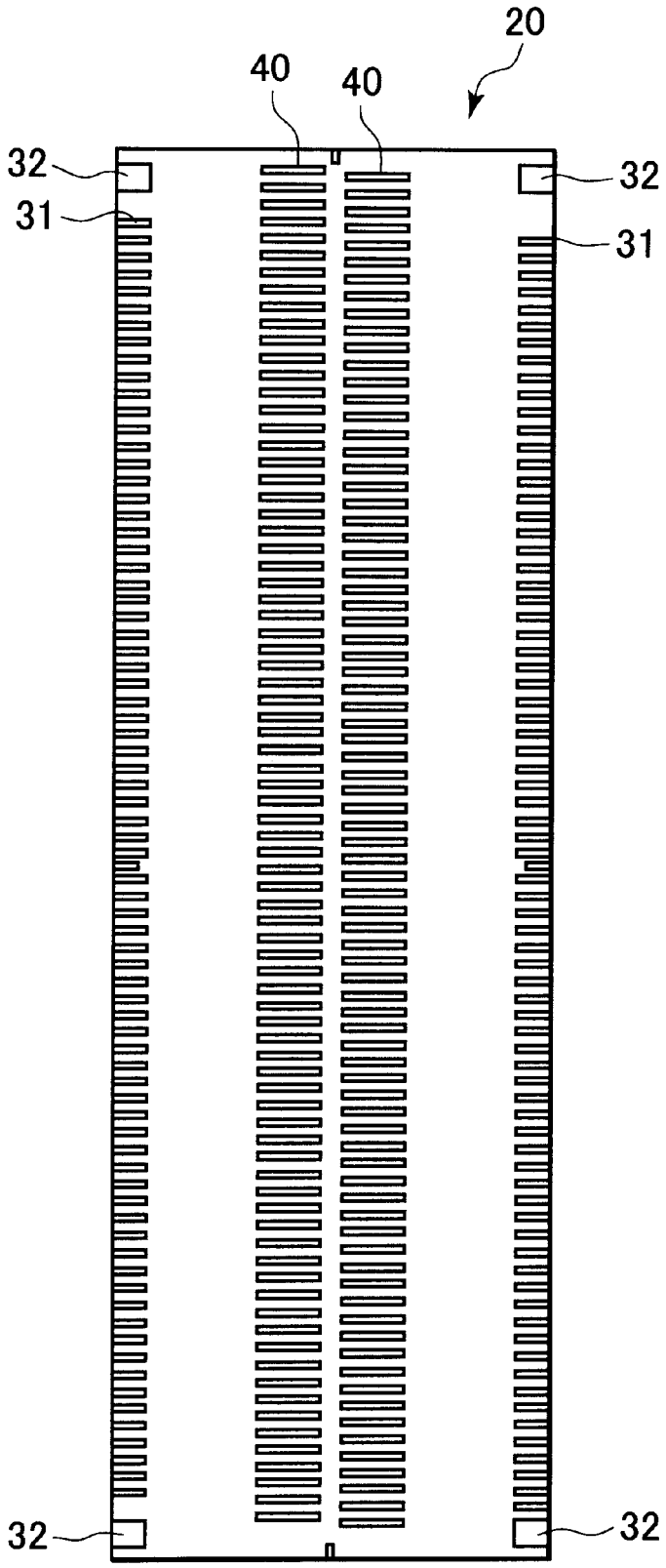
FIG. 8 is a plan view showing the plate-shaped piezoelectric actuator.

As shown in FIGS. 5 to 7, the plate-shaped piezoelectric actuator 20 is formed from ten piezoelectric sheets 21 to 30 that are stacked in a laminated configuration. The piezoelectric sheets 26, 28, and 30 are formed in the same configuration. Narrow drive electrodes 36 shown in FIG. 6 are formed on the upper surface of each piezoelectric sheet 26, 28, and 30 at positions that correspond to the pressure chambers 16 provided on the cavity plate 10. One end 36*a* of each drive electrode 36 is formed so as to be exposed at the side surface 26*a*, 26*b* of the corresponding piezoelectric sheet 26, 28, 30. Land dummy pattern electrodes 36' that do not contribute to deformation of the piezoelectric sheet are also formed on the upper surface of the piezoelectric sheets 26, 28, 30.

As shown in FIGS. 6 and 7, the piezoelectric sheets 23, 24, 25, 27, and 29 are formed in the same configuration. A band-shaped common electrode 35 is formed on the surface of each of the piezoelectric sheets 23, 24, 25, 27, and 29 and serves as a common electrode for a plurality of the pressure chambers 16. Each common electrode 35 is formed so as to expose its end portions 35*a* at the side surfaces 23*a*, 23*b* of corresponding piezoelectric sheets 23, 24, 25, 27, 29. Land dummy pattern electrodes 35' that do not contribute to deformation of the piezoelectric sheet are also formed on the upper surface of the piezoelectric sheets 23, 24, 25, 27, and 29.

As shown in FIGS. 5 to 8, upper surface electrodes 31, 32 are formed on the upper surface of the uppermost piezoelectric sheet 21. The electrodes 31, 32 are aligned in rows along the side surfaces 21*a*, 21*b* of the piezoelectric 21. The upper surface electrodes 31 are located in vertical alignment with the drive electrodes 36. The upper surface electrode 32 is vertically aligned with the common electrode 35. Also, two rows of dummy electrodes 40 are provided in between the rows of the upper surface electrodes 31. The dummy electrodes 40 are formed in a substantially rectangular shape to the same thickness of the upper surface electrodes 31 at positions corresponding to the columns 16*e* in the cavity plate 10.

The dummy electrodes 40 are pressed against and support the flat surface of an adhering tool (not shown) that operates to adhere the plate-shaped piezoelectric actuator 20 to the cavity plate 10, and are not connected in any way to the common electrode 35 or to the drive electrodes 36. Also, the piezoelectric sheet 22 below the uppermost piezoelectric sheet 21 is formed of the same material as the uppermost piezoelectric sheet 21, but is not provided with any electrodes.

It should be noted that although according to the present embodiment three piezoelectric sheets 26, 28, 30, are provided with drive electrodes 36, the plate-shaped actuator 20 could instead be provided with any optional number, such as 1, 2, or 5, of layers of piezoelectric sheets with drive electrodes 36. Common electrodes 35 could be provided in correspondence with this number.

The piezoelectric sheets 21 to 30 are manufactured according to the following method. First, a ceramic powder of lead zirconate titanate (PZT: $PbTiO_3.PbZrO_3$) with strong conductive properties is prepared and mixed with a binder and a solvent. The mixture is adjusted to a viscosity of 10,000 to 30,000 CPS. The mixture is then spread out on a plastic film, such as polyethylene terephthalate (PET), and dried to form 10 piezoelectric sheets of about 22.5 μm to 30.0 μm thickness.

Further, a metal material is screen printed on these piezoelectric sheets to produce the various electrodes described above. That is, three of these piezoelectric sheets are screen printed with the drive electrodes 36 and the dummy pattern electrodes 36' to produce the piezoelectric sheets 26, 28, and 30. Five are screen printed with the common electrodes 35 and the dummy pattern electrodes 35' to produce the piezoelectric sheets 23, 24, 25, 27, and 29. One is screen printed to produce upper surface electrodes 31, 32 and the dummy electrodes 40 to produce the piezoelectric sheet 21. The remaining one piezoelectric is not screen printed and is used as the piezoelectric sheet 22.

The piezoelectric sheets 21 to 30 are then stacked into a laminated block ten-layers thick with the piezoelectric sheet 30 at the bottom and the other piezoelectric sheets in the order of 29, 28, 27, 26, 25, 24, 23, 22, 21 on top. The ten-layer laminated block is then heat pressed, degreased, and then sintered.

Figure 9:
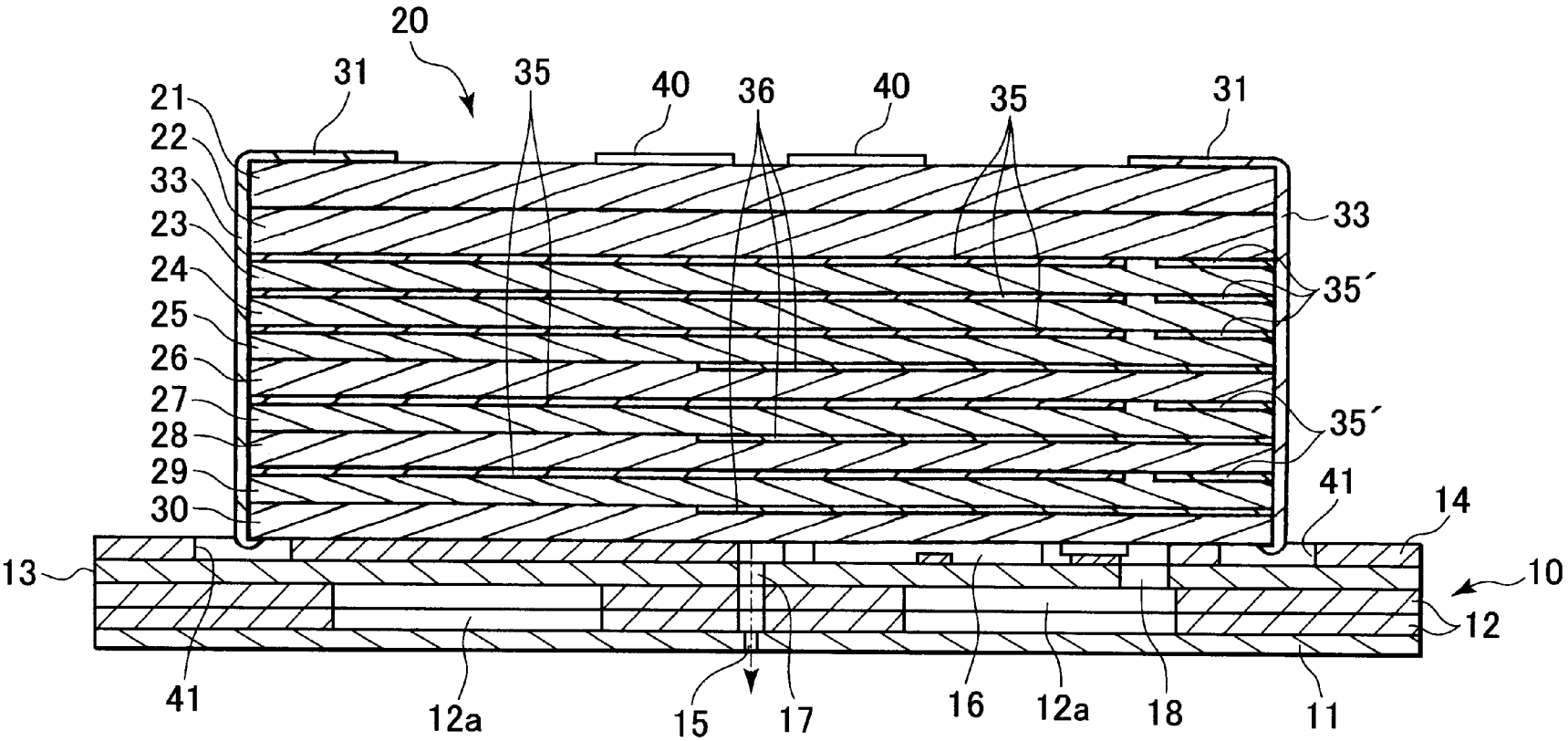
FIG. 9 is a cross-sectional view showing the plate-shaped piezoelectric actuator connected to the cavity plate.

Then as shown in FIG. 5, side electrodes 33, 34 are formed on the left and right side surfaces of the piezoelectric actuator 20. The left and right side surfaces of the piezoelectric actuator 20 extend perpendicular to the upper and lower surfaces of the piezoelectric actuator 20. The side electrodes 33 electrically connect the drive electrodes 36 and the upper surface electrodes 31. The side electrode 34 electrically connects the common electrode 35 and the upper surface electrodes 32. This completes processes for forming the plate-shaped actuator 20 as shown in FIG. 9.

Next, the cavity plate 10 and the plate-shaped piezoelectric actuator 20 are adhered together. An electrically conductive adhesive is coated to the lower surface of the piezoelectric sheet 30. The lower surface of the piezoelectric plate 30 is aligned so as to cover the pressure chambers 16 of the cavity plate 10. The piezoelectric actuator 20 is then mounted on the cavity plate 10. Next, an adhering tool, with a flat bottom surface, presses down on the plate-shaped piezoelectric actuator 20 with a force of about 10 kg-weight to adhere the cavity plate 10 and the plate-shaped piezoelectric actuator together.

Because the surface electrodes 31, 32 and the dummy electrodes 40 are formed on the upper surface of the plate-shaped piezoelectric actuator 20, the adhering tool presses against the upper surface of the plate-shaped piezoelectric actuator 20 through the surface electrodes 31, 32 and the dummy electrodes 40. Accordingly, even if there is some undulation in a portion of the plate-shaped piezoelectric actuator 20, the force applied by the adhering tool is transmitted to the dummy electrodes 40 in the center of the plate-shaped piezoelectric actuator 20 so that the undulation in the plate-shaped piezoelectric actuator 20 is pressed out. As a result, the plate-shaped piezoelectric actuator 20 can be reliably adhered to the upper surface of the cavity plate 10 with no gaps.

The grooves 41 formed in the base plate 14 prevent the lower edge of the side surface electrodes 33 provided on the side surface of the piezoelectric actuator 20 from short circuiting with the cavity plate 10. As shown in FIG. 5, the lower edge of the side surface electrode 34 contacts and becomes electrically connected with the contact portion 42 at the upper surface of the base plate 14, which is the uppermost layer of the cavity plate 10. It should be noted that the lower edge portion of the side surface electrode 34 can be connected to the contact portion 42 by soldering.

Next, the piezoelectric sheets 25 to 30, which are the active layers, are subjected to polarization processes by applying a voltage of about 2.5 Kv/mm between the common electrode 35 of the piezoelectric sheet 25 and the drive electrode 36 of the piezoelectric 26, between the common electrode 35 of the piezoelectric sheet 27 and the drive electrode 36 of the piezoelectric sheet 28, between the common electrode 35 of the piezoelectric sheet 29 and the drive electrode 36 of the piezoelectric sheet 30, and between the drive electrode 36 of the lowermost piezoelectric sheet 30 and the cavity plate 10. It should be noted that this process also polarizes the lowermost piezoelectric sheet 30 to function as an active layer.

Then, the flexible flat cable 50 is stacked as shown in FIG. 2 onto the upper surface of the piezoelectric plate 21 and pressed. As a result, the various wiring patterns (not shown) of the flexible flat cable 50 become electrically connected with the upper surface electrodes 31, 32.

Figure 10:
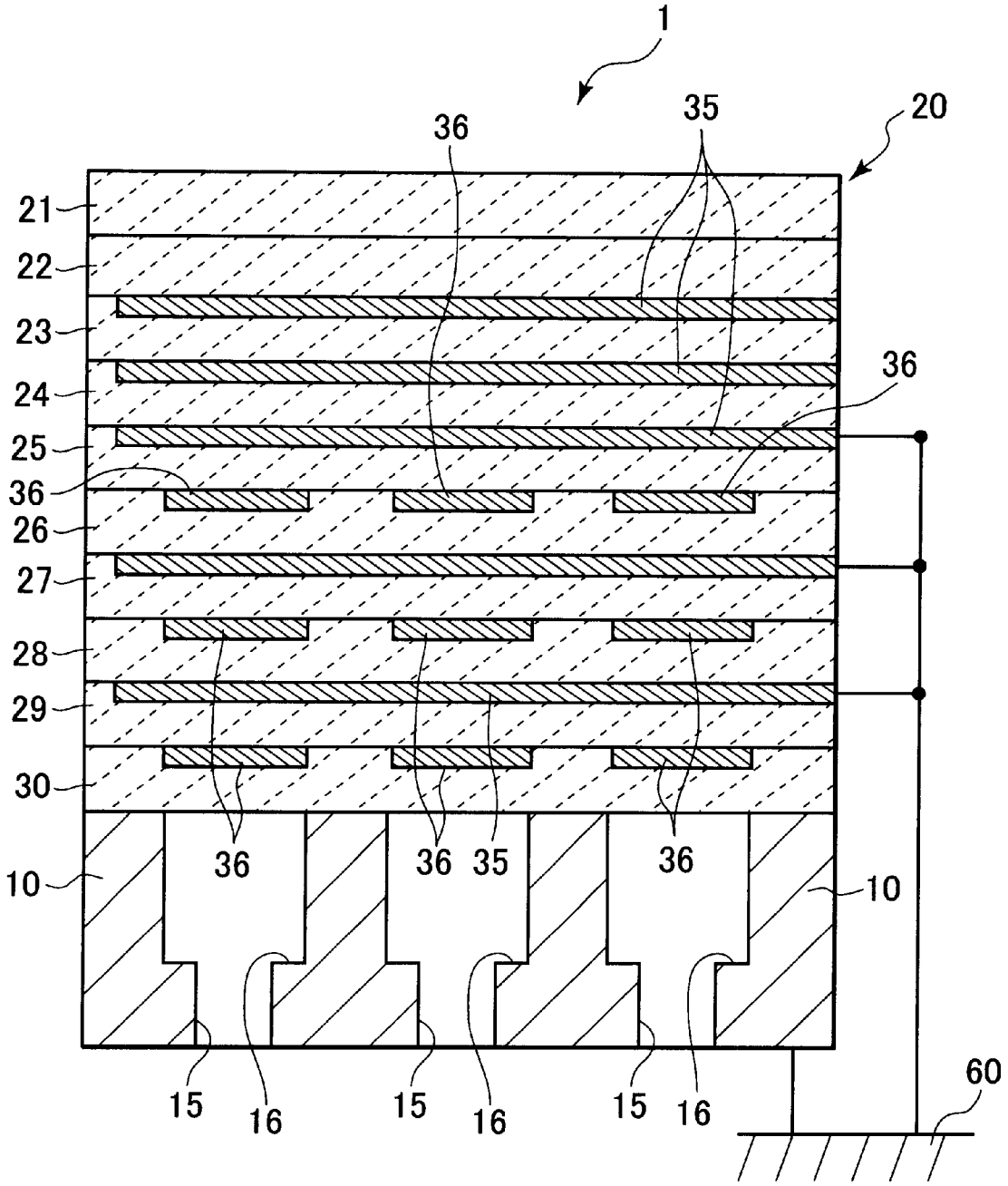
FIG. 10 is a cross-sectional view schematically showing electrical connection of components in the head of FIG. 1.

Next, an explanation for electrical connections in the ink jet printer head 1 will be provided while referring to FIG. 10. As shown in FIG. 10, the common electrodes 35 provided on the piezoelectric sheets 25, 27, 29 and the cavity plate 10 are all connected to the ground 60, i.e., to the same potential. Accordingly, the common electrode 60 is connected to a negative ground electrode when the drive electrodes 36 of the piezoelectric sheets 26, 28, and 30 are applied with a positive voltage, and to a positive ground electrode when the drive electrodes 36 of the piezoelectric sheets 26, 28, and 30 are applied with a positive voltage.

Figure 11:
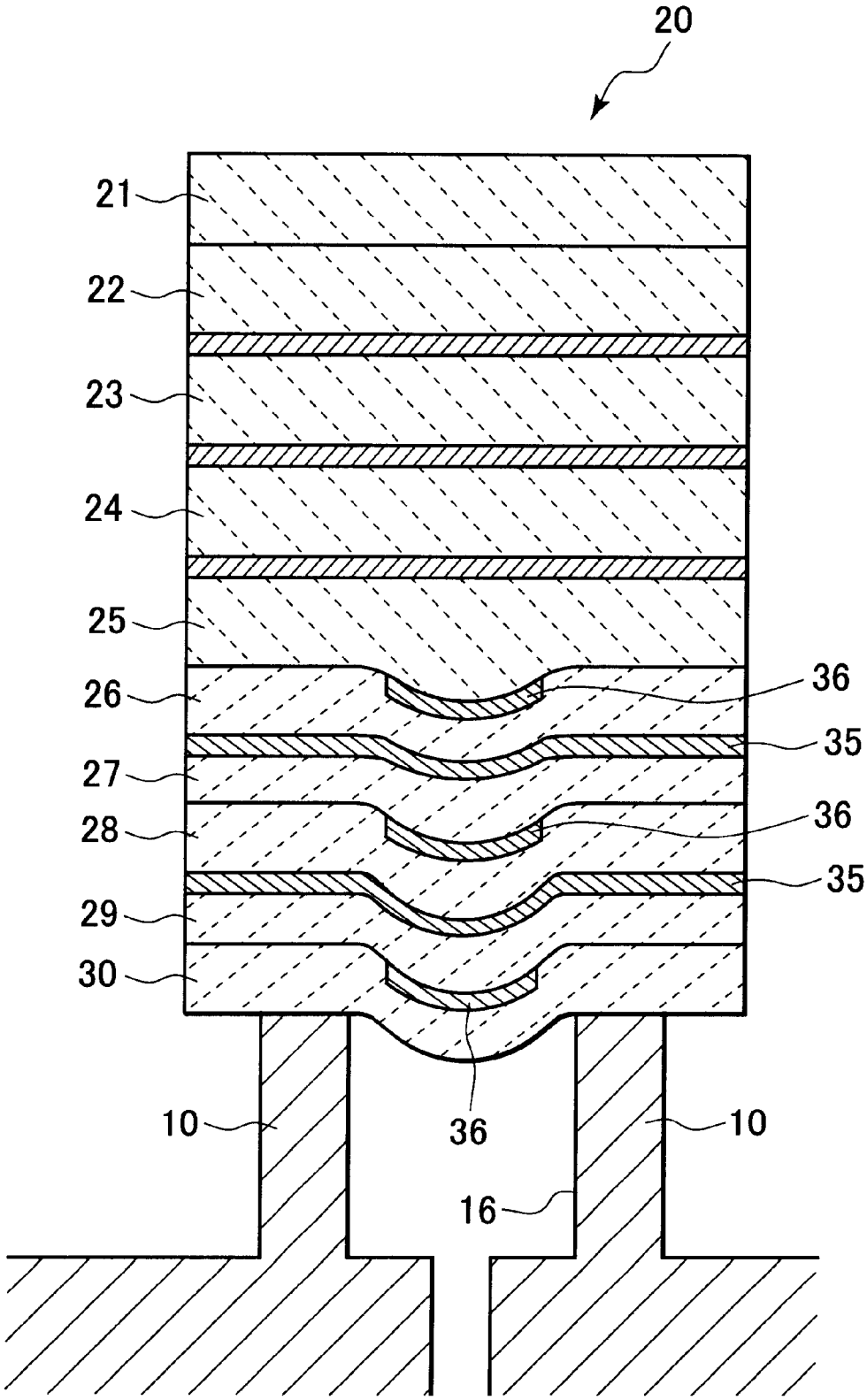
FIG. 11 is a cross-sectional view showing the head of FIG. 1.

Pressure can be applied to the ink in the ink pressure chambers 16 of the cavity plate 10 by applying a drive voltage between the common electrode 35 of the piezoelectric sheet 25 and the drive electrode 36 of the piezoelectric 26, between the common electrode 35 of the piezoelectric sheet 27 and the drive electrode 36 of the piezoelectric sheet 28, between the common electrode 35 of the piezoelectric sheet 29 and the drive electrode 36 of the piezoelectric sheet 30, and between the drive electrode 36 of the lowermost piezoelectric sheet 30 and the cavity plate 10 so that the piezoelectric sheets 25 to 30 deform in a manner shown in FIG. 11 without undesirable application of voltage to the ink in the cavity plate 10.

In this manner, the piezoelectric sheets 25 to 30 configure the active layers. On the other hand, the he piezoelectric sheets 21 to 24 serves as constrained layers. Specifically, because the piezoelectric ceramic and the metal material that forms the electrodes have different contraction rates, sintering the piezoelectric sheets 21 to 30 damages the flatness of the piezoelectric sheets 21 to 30.

However, the constrained layers prevent rippling or turning up at the edges and prevent the damage to the flatness. Moreover, the piezoelectric sheets 26 to 30 can deform only toward the pressure chambers 16 because of the constrained layers.

Next, an explanation for operations of the ink jet printer head 1 will be provided while referring to FIGS. 10 and 11. When the drive electrodes 36 provided to the piezoelectric sheets 26, 28, 30 are applied with a drive voltage, then as shown in FIG. 11 the piezoelectric sheets 26 to 30 function as active layers and deform by the piezoelectric effect. At this time, a drive voltage is applied between the drive electrode 36 of the piezoelectric sheet 30 and the cavity plate 10, so that the piezoelectric sheet 30 also functions as an active layer and deforms. Accordingly, sufficient pressure is applied to the ink chamber 16 for ejecting an ink droplet.

As described above, according to the present invention, the lowermost piezoelectric sheet functions as an active layer without any electrode being provided to its lower surface that abuts the cavity plate.

Because the lowermost piezoelectric sheet functions as an active layer, a sufficient pressure can be applied to the ink chamber. Also, because there is no need to provide a separate insulation film on the lowermost piezoelectric sheet, manufacturing costs will not increase.

Because the piezoelectric actuator and the cavity plate are electrically conductive and adhered together by an adhesive with conductive properties, the piezoelectric actuator and the cavity plate are electrically connected so that the lowermost piezoelectric sheet functions as an active layer.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. An ink jet head comprising:

a cavity plate formed with a plurality of nozzles and a plurality of pressure chambers in one-to-one correspondence with the nozzles; and a piezoelectric actuator including a plurality of first piezoelectric sheets and a plurality of second piezoelectric sheets laminated in alternation, each of the first piezoelectric sheets being provided with a first electrode, each of the second piezoelectric sheets being provided with a second electrode, wherein one of the first piezoelectric sheets has a first surface on which the first electrode is provided and a second surface opposite from the first surface and provided with no electrode, the second surface being attached to the cavity plate while covering over the pressure chambers; and the cavity plate and the second electrodes are all connected to a same potential.

2. The ink jet head according to claim 1, wherein the second surface of the one of the first piezoelectric sheets is attached to the cavity plate by an electrically conductive adhesive.

3. The ink jet head according to claim 1, wherein the second surface of the one of the first piezoelectric sheets is conductive.

4. The ink jet head according to claim 1, wherein the piezoelectric actuator further includes a first side electrode that connects the first electrodes, and the cavity plate is provided with a prevention means for preventing the first side electrode from short-circuiting with the cavity plate.

5. The ink jet head according to claim 4, wherein the prevention means is a groove formed in the cavity plate that receives an edge of the first,side electrode.

6. The ink jet head according to claim 1, wherein the piezoelectric actuator further includes a second side electrode that connects the second electrodes and the cavity plate.

7. The ink jet head according to claim 1, wherein each of the first piezoelectric sheets is provided with a plurality of first electrodes at positions that correspond to the pressure chambers.

8. The ink jet head according to claim 1, wherein the cavity plate and the second electrodes are all connected to the ground.

9. A manufacturing method for an ink jet head, comprising the steps of:

forming a laminated structure of a plurality of first piezoelectric sheets and a plurality of second piezoelectric sheets laminated in alternation, each of the first piezoelectric sheets being provided with a first electrode on a first surface, each of the second piezoelectric sheets being provided with a second electrode;

attaching a second surface of a lower most one of the first piezoelectric sheets to a cavity plate, the second surface being opposite from the first surface; and polarizing the first piezoelectric sheets and the second piezoelectric sheets by applying a voltage between the first electrodes and corresponding ones of second electrodes and between the first electrode on the lower most one of the first piezoelectric sheets and the cavity plate.

10. The manufacturing method of claim 9, wherein the second surface of the lower most one of the first piezoelectric sheets is attached to the cavity plate by an electrically conductive adhesive.

11. The manufacturing method of claim 9, further comprising the step of connecting the cavity plate and the second electrodes to a same potential.

12. The manufacturing method of claim 9, further comprising the step of connecting the cavity plate and the second electrodes to the ground.

* * * * *